US005531438A

United States Patent [19]

Corley

[11] Patent Number: 5,531,438

[45] Date of Patent: Jul. 2, 1996

[54] BATTING PRACTICE DEVICE

[76] Inventor: Deryl Corley, 7108 Carolenna Ct., North Richland Hills, Tex. 76180

[21] Appl. No.: 329,490

[22] Filed: Oct. 26, 1994

[51] Int. Cl.[6] ..... A63B 69/00

[52] U.S. Cl. ..... 273/26 E; 273/413

[58] Field of Search ..... 273/26 E, 29 A, 273/58 C, 413, 15 R

[56] References Cited

U.S. PATENT DOCUMENTS

| | | | |
|---|---|---|---|
| 1,608,849 | 11/1926 | Gilmour | 273/413 |
| 2,496,795 | 2/1950 | Johnson | 273/413 |
| 2,506,825 | 5/1950 | Carlson | 235/91 |
| 2,621,046 | 12/1952 | Lamounette | 273/413 |
| 3,288,413 | 11/1966 | Gregory | 273/413 X |
| 3,637,209 | 1/1972 | Raut | 273/26 E |
| 3,762,705 | 10/1973 | Gonzalez | 273/26 R |
| 3,764,140 | 10/1973 | Lofty | 273/413 |
| 3,790,171 | 2/1974 | Anderson | 273/413 |
| 3,893,669 | 7/1975 | Myers | 273/29 A |
| 3,897,057 | 7/1975 | Pennington | 273/26 E |
| 3,940,132 | 2/1976 | Lopatto, III | 273/29 A |
| 3,942,794 | 3/1976 | Gowins | 273/26 E |
| 3,953,029 | 4/1976 | Boyd | 273/413 |
| 4,093,225 | 6/1978 | Oliver | 273/413 |
| 4,173,340 | 11/1979 | Kanno | 273/413 |
| 4,555,110 | 11/1985 | Hai-Ping | 273/26 E |
| 4,664,375 | 5/1987 | Tetreault | 273/26 E |
| 4,869,501 | 9/1989 | Anastasakis | 273/1.5 R |
| 4,872,675 | 10/1989 | Crowden | 273/26 E |
| 5,135,219 | 8/1992 | McKeon et al. | 273/26 E |
| 5,203,558 | 4/1993 | An | 273/29 A |
| 5,228,683 | 7/1993 | Beimel | 273/26 R |
| 5,271,618 | 12/1993 | Malwitz | 273/26 E |
| 5,282,615 | 2/1994 | Green | 273/26 E |

*Primary Examiner*—William H. Grieb
*Attorney, Agent, or Firm*—Jenkens & Gilchrist

[57] ABSTRACT

This invention relates to a batting practice device for teaching and improving a person's batting and switch hitting techniques. More particularly, this invention relates to a ball tethered at the end of a rope wherein the opposing end of the rope is rotatably attached to a vertical member thereby allowing the ball to rotate continuously about the vertical member.

19 Claims, 6 Drawing Sheets

BATTING PRACTICE DEVICE

BACKGROUND OF THE INVENTION

1. Field of the Invention

This invention relates to a batting practice device for teaching and improving a person's batting and switch hitting techniques. Furthermore, this invention relates to a tennis ball hitting device for teaching and improving a tennis player's stance, stroke, fore-hand and back-hand techniques. More particularly, this invention relates to a ball tethered at the end of a rope wherein the opposite end of the rope is rotatably attached to a vertical member thereby allowing the tethered ball to rotate continuously about the vertical member. The vertical member can be supported by a stand such that when a user hits the tethered ball the stand maintains the apparatus in an upright position. Furthermore, the entire apparatus can be collapsible for easy storage and carrying.

2. History of the Prior Art

Being able to bat properly is the key to a high batting average in baseball or softball. Many hours of hitting are required for perfecting a swing. Batters must practice many hours to improve their batting stance, eye-hand coordination and to develop a repeatable consistent swing and switch hitting swing. Ordinarily, to practice batting a pitcher or pitching machine is required. Field players are also required to retrieve the balls after they are hit. Thus, a variety of people and a quantity of balls are required for a single person to practice batting.

Mechanical devices have been introduced in the past to aid in the training of batting. As mentioned earlier, there exists a ball pitching machine. Such a machine is expensive, requires a large quantity of balls and fielders to retrieve the balls. There also exist mechanical devices wherein a ball is attached to a horizontal or near-horizontal boom. The horizontal boom is either a semi-rigid or rigid member which rotates on or about a vertical axis. These horizontal boom devices have a distinct drawback that the boom, having mass, can distort the momentum of an attached ball prior to or after being hit. The momentum of the boom also can mislead the batter into hitting a ball incorrectly. The boom is used in the devices to enable the ball to be rotated by a mechanical mechanism at the center of the circumference of the ball's path.

Furthermore, previous batting devices require disassembly and are cumbersome to store and carry. Thus, there is a need for a batting practice device which closely simulates the momentum of a pitched ball and also allows a batter to comprehend when the ball is being hit correctly. Such a batting device should require no more than the batter to operate it, set it up, collapse it down, and carry and store it. Furthermore, the device should be inexpensive and not overly mechanical.

In a similar respect, practicing tennis, or other related sports, generally requires more than one person. That is, one person must serve the ball to another person so that stance, swing and fore-hand and back-hand abilities can be practiced. Mechanical tennis ball cannons have been introduced, but these machines are expensive and require a multitude of balls. Furthermore, extra time must be spent picking up balls after the tennis cannon is empty.

Based on the above, there is a need for a device allowing one person to practice batting or racket sport techniques that substantially simulates the feel of batting or racket hitting, without using a plurality of balls.

SUMMARY OF THE INVENTION

Accordingly, it is an object of the present invention to produce a batting practice device that provides a batter with a moving ball having substantially the same momentum as an actually pitched ball.

Furthermore, it is an object to the present invention to provide an apparatus for enabling a batter to learn the basics of hitting, including form, stance and switch hitting.

It is also an object of the present invention to provide an apparatus for practicing racketting, such as hitting a ball with a tennis racket, for the purpose of practicing stance, stroke, as well as fore-hand and back-hand techniques.

Furthermore, it is an object of the present invention to provide a batting or racketting apparatus that is mobile, and easy to set up, collapse, carry and store.

The above and other objects are achieved by providing an apparatus for improving and practicing a batter's batting technique. Such a batting apparatus could have a base for stably supporting the apparatus. The base can be connected to a vertical pole. At the top of the pole a rope is rotationally attached to the pole. The opposite end of the rope is attached to a ball.

A batter can swing the ball about the pole at a desired speed and height and practice batting. The batter can practice switch hitting, and batting stance techniques. Only one person is required to operate the batting device and the device is relatively inexpensive to manufacture. Furthermore, the batting device can be collapsible such that it is easy to carry and store when not in use.

Such a device can be easily modified to allow a tennis, or other racket sport player, to practice various techniques associated with the selected racket sport.

BRIEF DESCRIPTION OF THE DRAWINGS

These and other objects and advantages of this invention will become apparent and more readily appreciated from the following description of the presently preferred exemplary embodiments, taken in conjunction with the accompanying drawings of which.

DETAILED DESCRIPTION

Figures 1, 2:
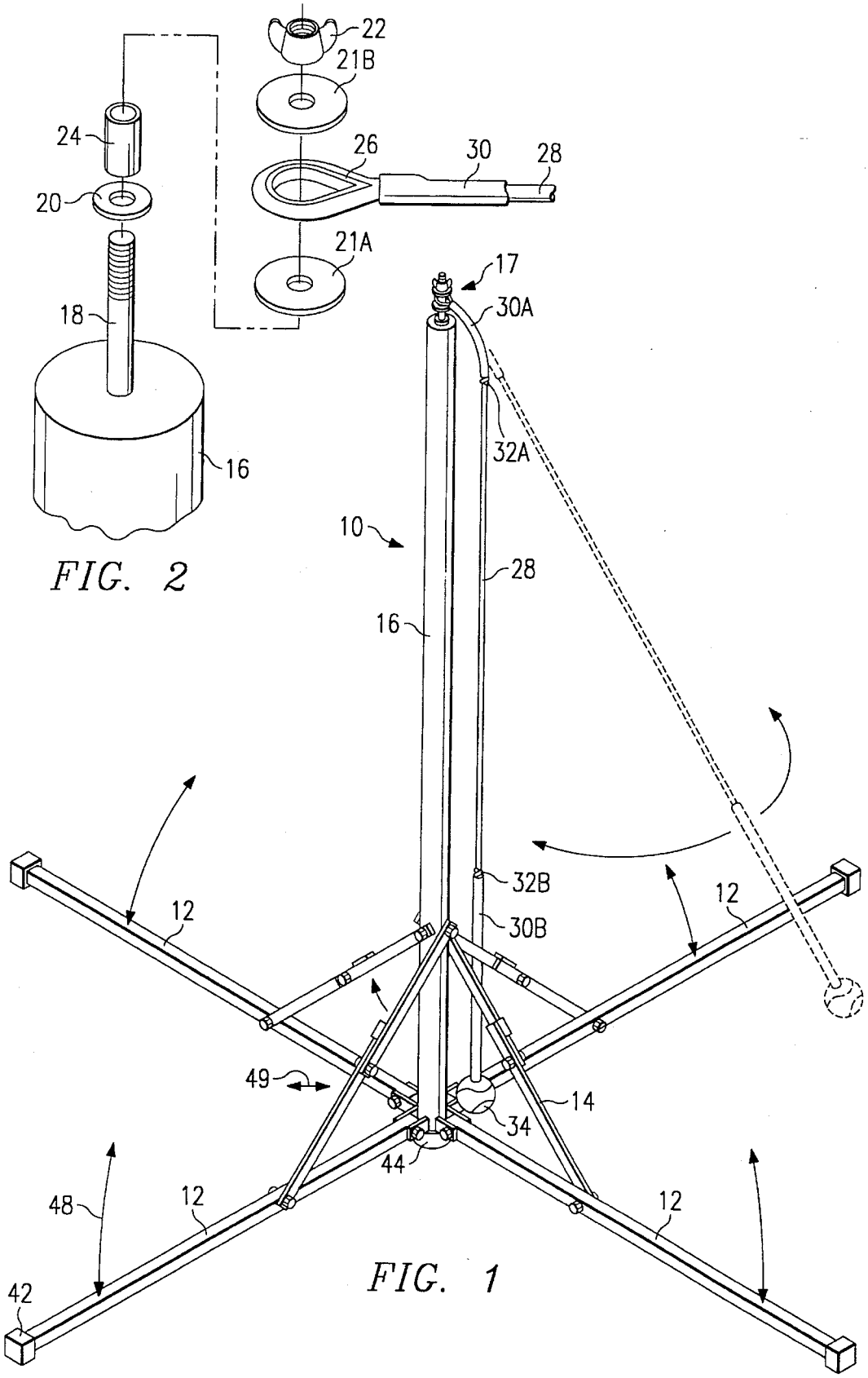
FIG. 1 is a perspective view of a first embodiment of the batting device of the present invention.
FIG. 2 is a first component view of the top of the batting device of the present invention.
Figure 4:
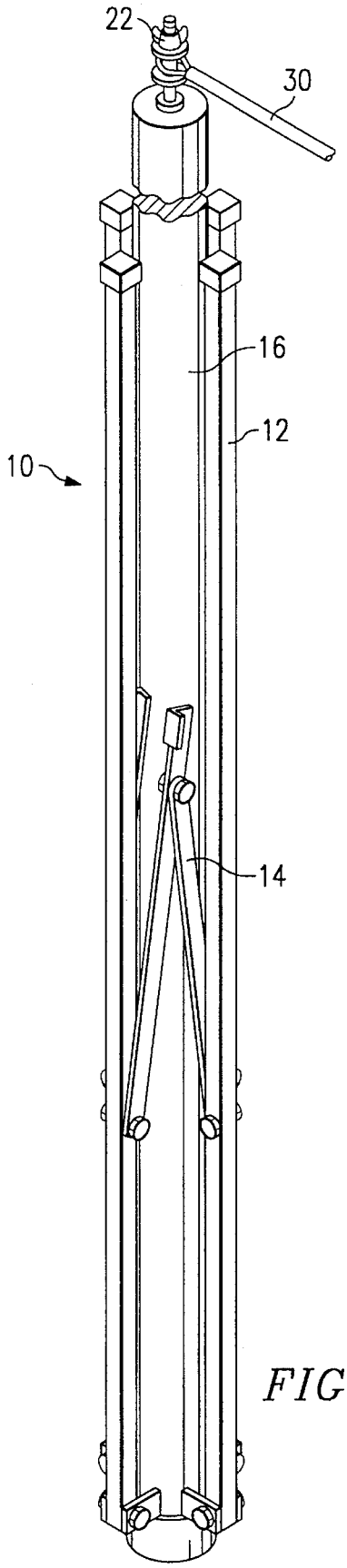
FIG. 4 is a perspective view of the first embodiment of the batting device of the present invention when in a folded position.

Practicing techniques of batting are easily accomplished with the various preferred exemplary embodiments of the present invention. FIG. 1 depicts a first exemplary embodiment of the present invention. The batting practice device 10 has four legs 12 to maintain stability while the batting practice device 10 is in use. The legs 12 are attached to a vertical member 16 via hinges or a similar configuration. Folding leg braces 14 are movably attached to both the vertical member 16 and the legs 12. The folding leg braces 14 fixably support and stabilize the vertical member 16 when the batting device is in an open position (as shown in FIG. 1). The leg braces fold out so that the batting device can be collapsed and folded up as depicted in FIG. 4 ( see arrows 48 and 49 ).

The legs 12, foldable leg braces 14, and vertical member 16 are preferably made of metal, but can also be made out of wood, plastic hard rubber or any other durable substance. Preferably, the legs are each about five feet long.

Figure 3:
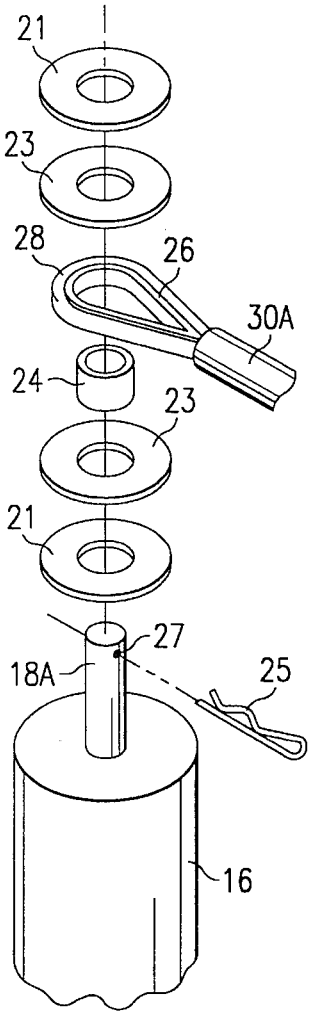
FIG. 3 is a second component view of the top of the batting device of the present invention.

At the top of the batting device 10 is a rotational mechanism 17 for allowing a tethered ball 34 to rotate about the vertical member 16. Exemplary rotational mechanisms 17 are depicted in FIGS. 2 and 3. The rotational mechanism 17 of FIG. 2 comprises a bolt 18 which extends vertically upwards from and is fixably attached to the vertical member 16. The bolt 18 has a smooth lower portion and a threaded upper portion. Onto the bolt is placed a washer 20, bushing 24, washers 21A and 21B and wing nut 22. A thimble 26 is between washers 21A and B. Preferably bushing 24 and washers 21A and B are made of nylon or plastic or another equivalent. The combination of the parts allows the thimble 26 to rotate about the bolt 18 in a stable secure manner.

The rotational mechanism 17 of FIG. 3 comprises a bolt 18A which extends vertically upward from and is fixably attached to the vertical member 16. Bolt 18A is smooth. Onto the bolt 18A is placed two metal washers 21, two nylon washers 23 and a nylon bushing 24 as indicated in FIG. 3. The thimble 26 is looped about the nylon bushing 24 such that it is surrounded by the two nylon washers 23 and the nylon bushing 24. A clip-pin 25 is inserted into the hole 27 to keep all the parts in place on the bolt 19.

The rotational mechanism 17 allows the rope 28, which is clamped to the thimble by a ferrule, to rotate about the bolt 18A. Such configurations for the rotational mechanism 17 can rotate continuously, do not wear significantly over time and are relatively inexpensive. It is noted that the rotational mechanism 17 for allowing the tethered ball to rotate about the vertical member could be made various ways. Such a rotational means 17 for rotating could also incorporate bearings, rings, bushings, and a variety of other assembly parts.

Figure 5:
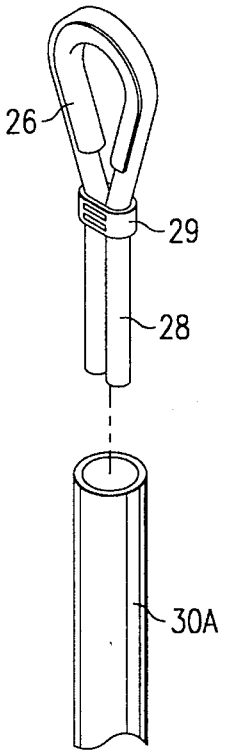
FIG. 5 is a view of the rope portion of an exemplary embodiment of the present invention.

The thimble 26 is attached to a rope or cord 28 via a ferrule 29 (FIG. 5). The ferrule 29 can be pressed to maintain its position and to tightly hold the rope 28 about the thimble 26. The rope 28 extends almost to the bottom of the vertical member 16. At the end of the rope 28 a ball 34 is fixably attached. The ball 34 is preferably a baseball, softball or tennis ball, but can be any equivalent such that the ball can be hit with a bat or racquet. The rope is preferably attached to the ball by drilling a hole in the ball 34, inserting the rope through the hole and tying a knot in the rope. Glue or adhesive can be used to further secure the ball into place. It is understood that there are various methods of securing a ball to the end of a cord. For example, the ball could be molded onto the cord. Thus, any means of securing the ball 34 will be sufficient so long as the ball cannot detach from the rope during use of the batting device 10. Preferably, the rope is about 7 feet long, but could be made to be variable in length as desired by the batter.

The thimble 26 is preferably made of metal, but can be any sufficient substance. The rope 28 must be strong enough to contain the centrifugal force of the ball 34 orbiting about the vertical member 16. The rope 28 must also be able to withstand the impulse forces generated when the ball 34 is batted.

Two soft plastic tubes 30A and 30B are placed on the rope 28 and secured with knots 32A and 32B (FIGS. 1, 2, 3 and 5 ). The plastic tube 30A performs a variety of functions. The plastic tube 30A stops the rope 28 and rotating means 17 from coming in contact with the top portion of the vertical member 16. The plastic tube 30A extends the useful life of the rope 28 and enhances the rope's ability to rotate about the vertical member 16 rather than wrapping about the vertical member 16. Furthermore, the plastic tube 30A can cover part of the ferrule 29 at the place where the rope 28 attaches thereby helping the ferrule 29 maintain its tightness on the thimble 26 and rope 28. Also, the plastic tubing 30A helps cosmetically cover the joining of the rope 28 to the ferrule 29 and thimble 26. FIG. 5 depicts the thimble 26, rope 28, ferrule 29, and plastic tubing configuration 30A.

Soft plastic tube 30B extends preferably 18"to immediately above the ball 34 on the rope 28. The plastic tube 30B serves multiple purposes. One, is that it helps steady the ball after the ball is hit so that the ball 34 orbits or rotates about the vertical member 16 without wobble; two, it acts as a cushion for catching the ball 34 and rope 28 combination as they rotate and swing past the batter; and three, it protects the rope 28 and bat ( not shown) when the batter misses the ball. The plastic tube 30B therefore, adds protection to the rope 28, bat and batter's hands.

The soft plastic tubes 30A and 30B are preferably very flexible rather than being semi-rigid or stiff but could be semi-rigid or stiff.

The first embodiment of the present invention can also have rubber feet 42 at the end of the legs 12 along with a rubber bottom 44 at the bottom of the vertical member 16 so that the batting device 10 can be used indoors in a gymnasium without ruining the floors while staying in place (FIG. 1). Instead of rubber feet, rubber tubing can be placed over the legs to protect floors and stop the batting device from moving.

Figure 7:
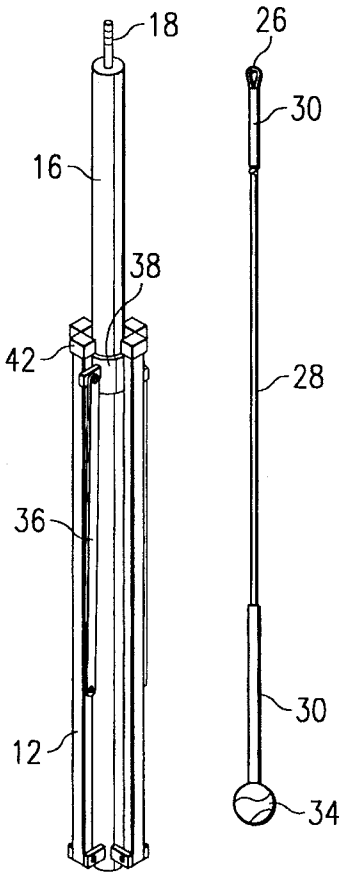
FIG. 7 is a perspective view of the second embodiment of the batting device of the present invention when in a folded position.
Figure 6:
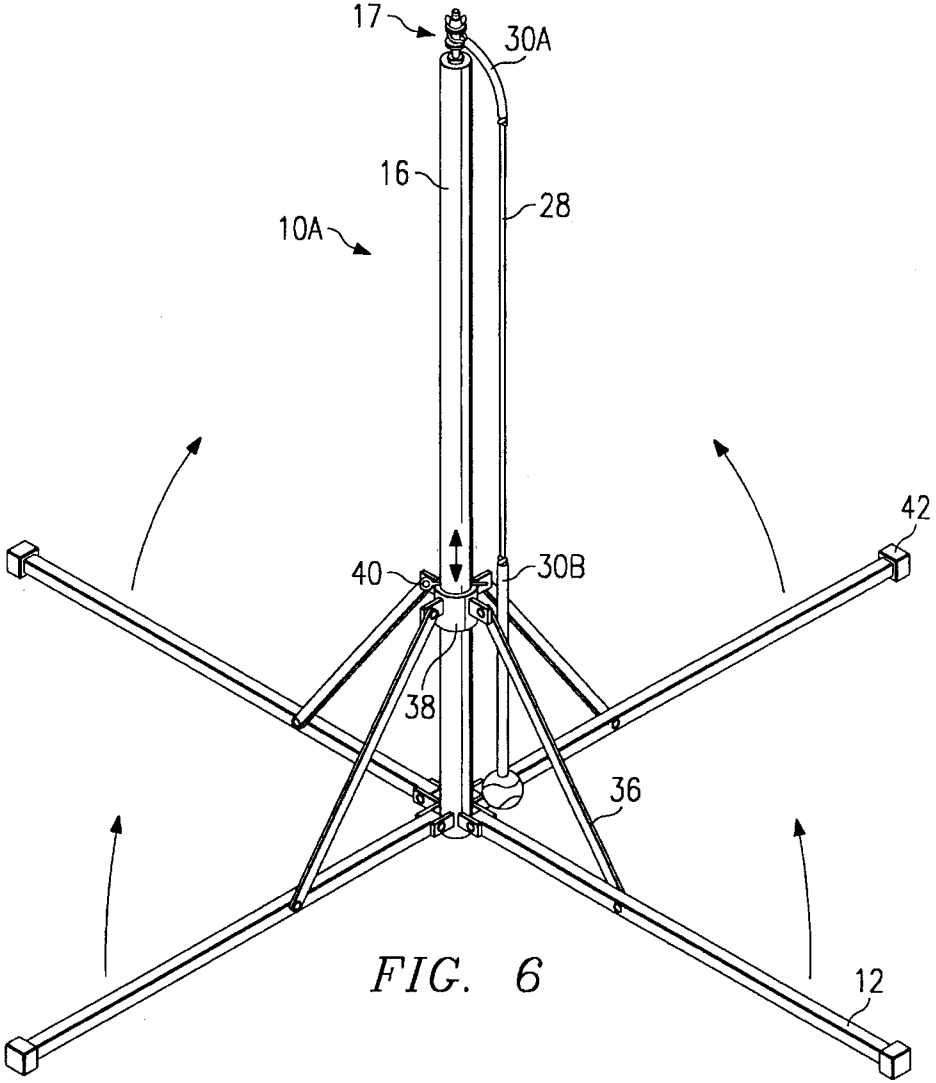
FIG. 6 is a perspective view of a second embodiment of the batting device of the present invention.

A second exemplary embodiment of the present invention is depicted in FIG. 6 and FIG. 7. It should be noted that similar parts are depicted with the same numeral. The second exemplary embodiment of the batting device 10A differs from the first embodiment of the present invention 10 mainly at the base of the device. The batting device 10A has legs 12 which are movably attached to the vertical number 16. Leg braces 36, comprising a solid bar are attached at one end to a central portion of an adjacent leg 12. The other end of the leg braces 36, are movably attached to a collar 38 which slides on the vertical member 16. When the batting device 10A is set up for use, the collar 38 is slid down the vertical member 16 and pin 40 is positioned in a locking mechanism which locks the base of the batting device 10A such that the legs 12 are in an opened position. It is understood that the locking device can be a variety of means which include, but are not limited to, a pin in a hole, spring loaded mechanisms, screw-in mechanisms, and clips. The remainder of the second exemplary embodiment of the present invention is similar to the first exemplary embodiment.

FIG. 7 depicts the second exemplary embodiment in a collapsed or folded position.

Figure 8:
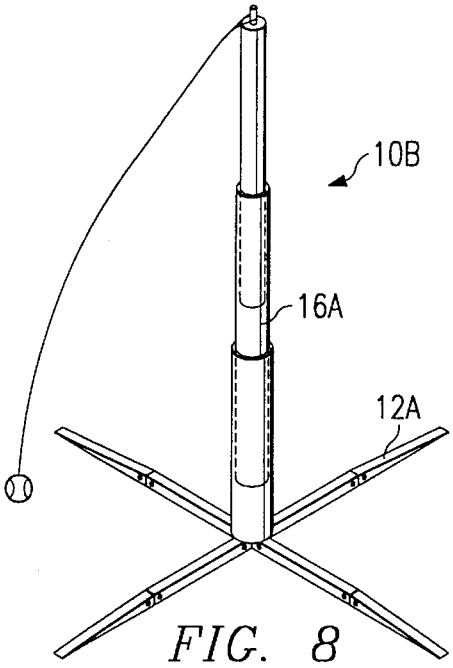
FIG. 8 is a perspective view of a third exemplary embodiment of the present invention.
Figure 9:
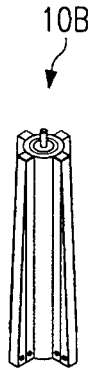
FIG. 9 is a side view of the third exemplary embodiment of the present invention in a folded, collapsible position.

FIGS. 8 and 9 depict a third embodiment of the present invention 10B wherein the legs 12*a* fold at a hinged point and the vertical member 16*a* is comprised of sectional telescoping pieces. The sectional telescoping pieces can lock into position using a locking mechanism which would be known to someone having ordinary skill in the art. FIG. 9 shows the third embodiment of the present invention in a folded, collapsed position which is easy to carry and store.

Figure 10A:
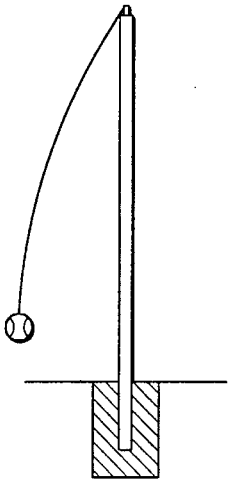
FIGS. 10A, B, C, D, and E are views of the present invention comprising a variety of exemplary base structures.
Figure 10B:
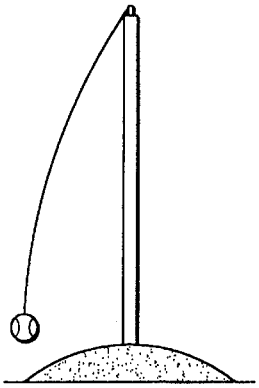
Figure 10C:
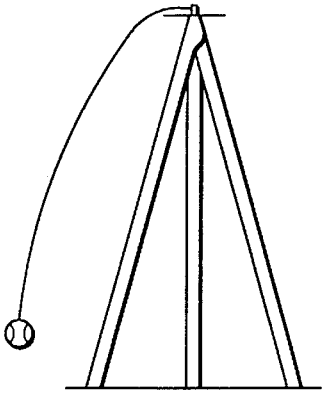
Figure 10D:
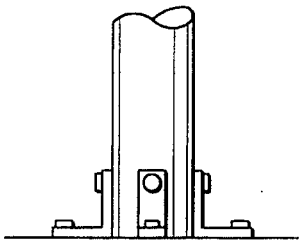
Figure 10E:
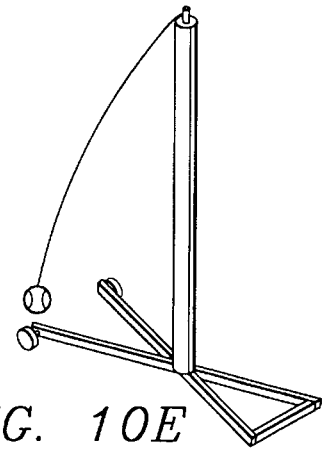

FIGS. 10A–E depict a variety of embodiments that could be used as a base for the batting device. FIG. 10A shows the use of concrete anchor; FIG. 10B indicates that any weighted base can be used; FIG. 10C shows a variation on the single vertical member; FIG. 10D indicates that the batting device can be bolted to the floor; and FIG. 10E shows how wheels can be affixed to the base so that the batting device can be transported by pushing or pulling it across the ground.

Figure 11:
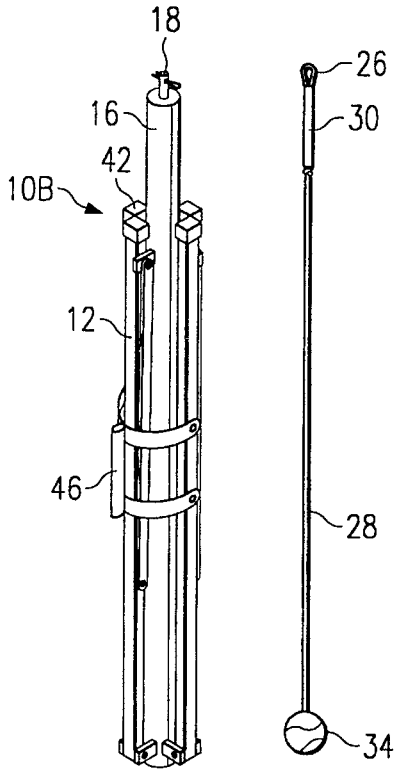
FIG. 11 is a perspective view of an embodiment of the present invention having a carrying handle.
Figure 12A:
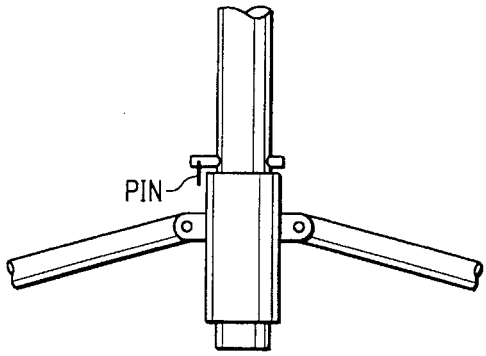
FIG. 12 is a chart indicating an exemplary use of an exemplary embodiment.
Figure 12B:
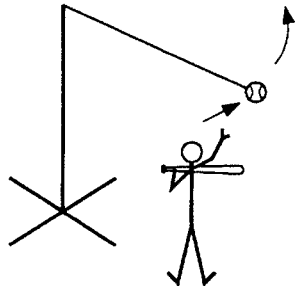
Figure 12C:
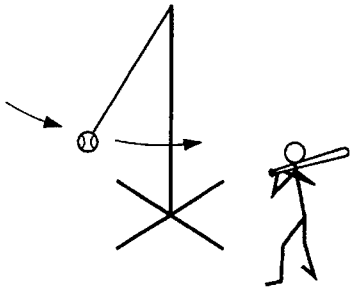
Figure 12D:
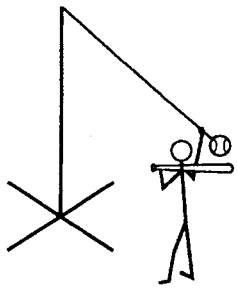
Figure 12E:
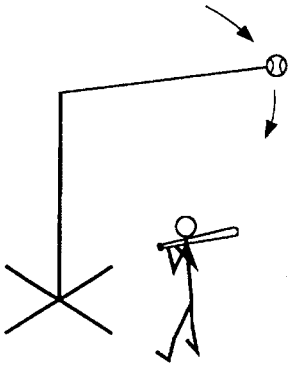
Figure 12F:
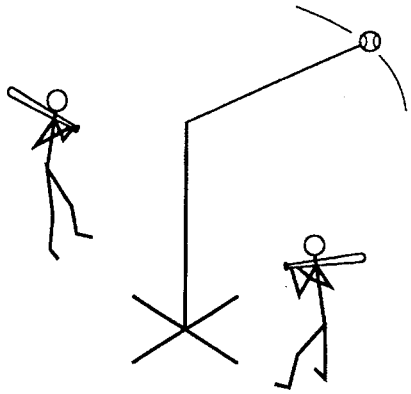

FIG. 11 depicts an embodiment of the present invention with carrying straps 46. The carrying strap could be made of plastic, rubber, leather or cloth and could be either flexible or solid. The carrying strap 46 allows a batter or other person to easily carry the exemplary batting device to and from a storage area.

FIG. 12 depicts the basic steps for using an exemplary embodiment of the present invention:

(1) Stand the batting device up and push the legs and collar down. Insert the pin above the collar.

(2) Throw the ball outward into a desired rotation;

(3) Hit the ball using a baseball bat;

(4)Catch the ball and rope by the plastic tubing and throw it outward again; or (5) Switch hit; or (6) Hit with a friend!

Figure 13:
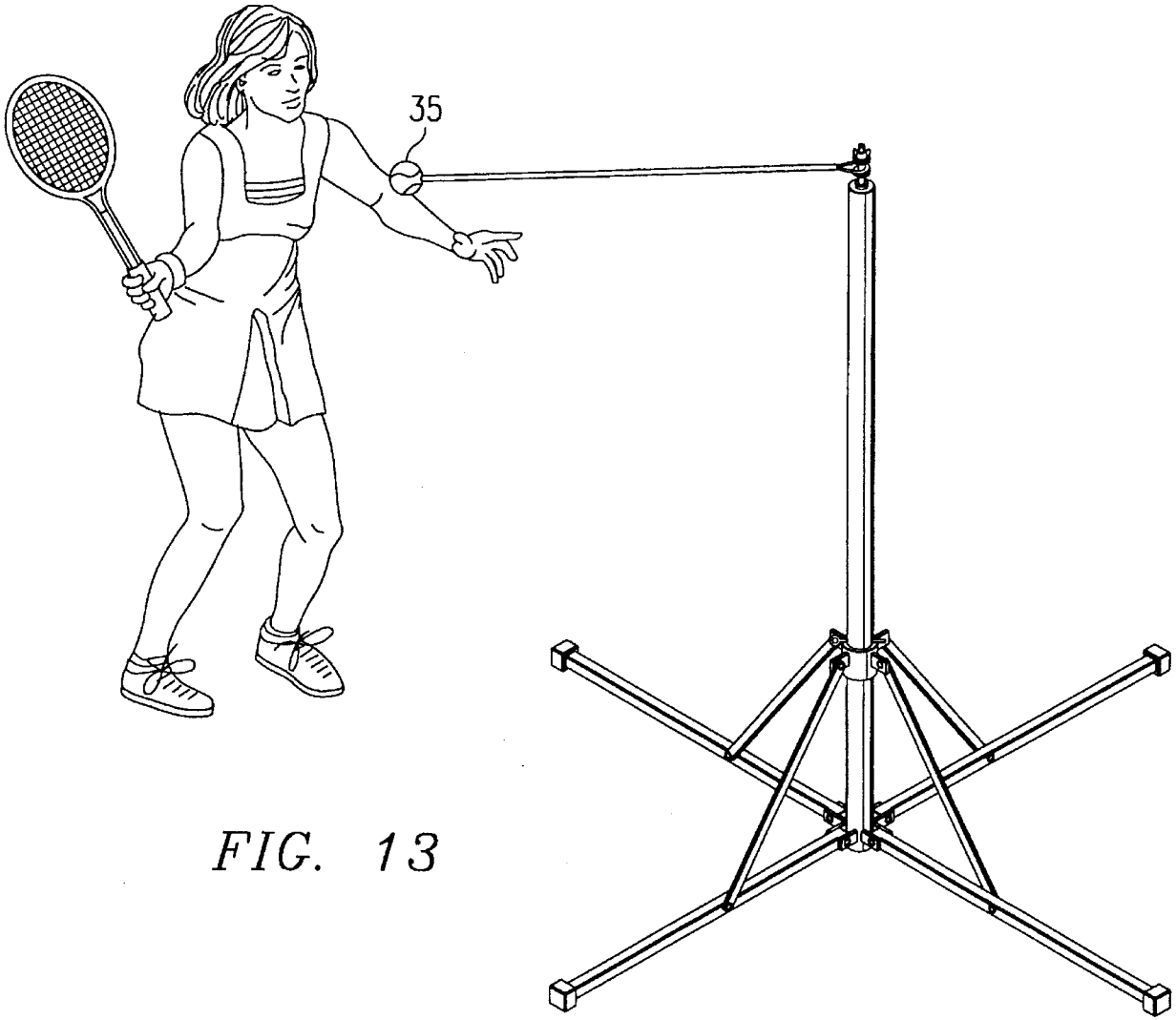
FIG. 13 depicts an embodiment of the present invention being used to practice a racket sport.

Techniques of tennis, or other racket sports, can be practiced using an exemplary embodiment of the present invention and tethering a tennis, or other, ball at the end of rope 28. FIG. 13 depicts a tennis player practicing stance, stroke as well as fore-hand and back-hand techniques with an exemplary embodiment of the present invention equipped with a tennis ball 35.

Although a few preferred embodiments of the invention have been now shown and described, it will be appreciated by those skilled in the art that changes may be made in these embodiments without departing from the principles and the spirit of the invention, the scope of which is defined in the appended claims.

What is claimed is:

1. An apparatus for practicing at least one of batting and racketing techniques comprising:

a base for supporting said apparatus;

a vertical member attached to said base;

a rotational mechanism comprising:

a stud portion which is fixably attached to said vertical member, having a smooth portion and a threaded portion;

a plurality of washers rotatably mounted on said stud portion;

a bushing rotatably mounted on said stud portion; and an eyelet rotatably mounted on said stud portion;

a rope having a first end fixably attached to said eyelet of said rotational mechanism; and a ball fixably attached to a second end of said rope; said rope and ball being capable of withstanding repetitive strikes from a bat; said ball capable of orbiting said vertical member in a continuous relatively horizontal path such that said rope does not wrap about said vertical member.

2. The apparatus of claim 1, wherein said base further comprises:

at least one leg, said leg having (1) an extended support position and (2) a folded collapsed position.

3. The apparatus of claim 2, wherein said base further comprises a locking means for locking said leg in said extended support position.

4. The apparatus of claim 2, further comprising means for carrying said apparatus when said leg is in said folded collapsed position.

5. The apparatus of claim 1, wherein the base comprises at least one wheel for moving said apparatus to a location.

6. The apparatus of claim 1, wherein said rope extends through at least one piece of flexible tubing.

7. The apparatus of claim 1, further comprising:

a first plastic tubing through which said rope extends, said first plastic tubing positioned at said first end of said rope;

a second plastic tubing through which said rope extends, said second plastic tubing positioned at said second end of said rope and adjacent to said ball.

8. A batting practice device comprising:

a ball;

a vertical member;

a rope having a first end fixably attached to said ball;

a rotational means for allowing said rope and said ball to be capable of continuously rotating about said vertical member, said rotational means being affixed to the top of said vertical member and said rope being rotatably attached to said rotational means said rotational means comprising:

a stud portion having a threaded and smooth portion;

a plurality of washers rotatably mounted on said stud portion;

a bushing rotatably mounted on said stud portion;

a first flexible tubing through which said rope passes being adjacent to said rotational means, said first flexible tubing inhibits said rope from wrapping about said vertical member;

a second flexible tubing through which said rope pass is adjacent to said ball, said second flexible tubing steadies said ball when it is hit and when it rotates about said vertical member; and a base attached to said vertical member for maintaining said vertical member in a vertical position.

9. The device of claim 8, wherein said base comprises at least one leg.

10. The device of claim 8, wherein said base comprises a means for fixably attaching said vertical member to the ground.

11. The device of claim 8, wherein said base comprises wheels for moving said device to a desired location.

12. The device of claim 8, wherein said device is collapsible.

13. The device of claim 12, wherein said device further comprises means for carrying said device.

14. A batting device comprising:

an upright base structure;

means for rotating mounted on top of said upright base structure, said means for rotating comprising:

a vertical stud portion attached to said upright base structure;

a bushing rotatably mounted on said vertical stud portion; and a plurality of washers rotatably mounted on said vertical stud portion;

a ball;

a rope having a first end removably attached to said rotating means and a second end fixably attached to said ball; and a first flexible plastic tube through which said rope extends being positioned at said first end of said rope adjacent to said rotating means.

15. The device of claim 14, further comprising a second flexible plastic tube through which said rope extends being positioned at said second end of said rope adjacent to said ball.

16. The device of claim 14, wherein said upright base structure is collapsible.

17. The device of claim 16, wherein the upright base structure has a carrying means for carrying said device when said upright base structure is in a collapsed position.

18. The device of claim 14, wherein said upright base structure comprises a vertical member.

19. The device of claim 14, wherein said base structure comprises at least one wheel for moving said device.

* * * * *